US005290113A

United States Patent [19]

Andoo et al.

[11] Patent Number: 5,290,113

[45] Date of Patent: Mar. 1, 1994

[54] WIRE DOT PRINTING HEAD

[75] Inventors: Hirokazu Andoo; Yoichi Umezawa; Mitsuru Kishimoto; Noboru Ooishi, all of Tokyo, Japan

[73] Assignee: Oki Electric Industry Co., Ltd., Tokyo, Japan

[21] Appl. No.: 781,204

[22] PCT Filed: Jun. 25, 1990

[86] PCT No.: PCT/JP90/00820

§ 371 Date: Dec. 13, 1991

§ 102(e) Date: Dec. 13, 1991

[87] PCT Pub. No.: WO91/00182

PCT Pub. Date: Jan. 10, 1991

[30] Foreign Application Priority Data

| | | | |
|---|---|---|---|
| Jun. 26, 1989 | [JP] | Japan | 1-73604 |
| Nov. 1, 1989 | [JP] | Japan | 1-127180 |
| Nov. 6, 1989 | [JP] | Japan | 1-129158 |

[51] Int. Cl.[5] ..... B41J 2/235

[52] U.S. Cl. ..... 400/124; 101/93.05

[58] Field of Search ..... 101/93.05; 400/124

[56] References Cited

U.S. PATENT DOCUMENTS

| | | | |
|---|---|---|---|
| 4,895,464 | 1/1990 | Rubinshtein | 101/93.05 |
| 4,921,364 | 5/1990 | Yasunago | 400/124 |
| 4,976,554 | 12/1990 | Shimosato et al. | 400/124 |
| 5,165,808 | 11/1992 | Andou et al. | 400/124 |

FOREIGN PATENT DOCUMENTS

| | | | |
|---|---|---|---|
| 57-88560 | 6/1982 | Japan . | |
| 58-92052 | 6/1983 | Japan . | |
| 58-96568 | 6/1983 | Japan . | |
| 59-146135 | 9/1984 | Japan . | |
| 60-120845 | 8/1985 | Japan . | |
| 61-179759 | 8/1986 | Japan . | |
| 0057255 | 3/1988 | Japan | 101/93.05 |
| 0010951 | 1/1992 | Japan . | |

*Primary Examiner*—Edgar S. Burr
*Assistant Examiner*—John S. Hilten
*Attorney, Agent, or Firm*—Spencer, Frank & Schneider

[57] ABSTRACT

A spring charge type wire dot printing head includes front cores 35 and rear cores 36 that are disposed in circles. The front and rear cores are used in pairs, and either one of these paired cores is wound with a coil 39 or 40. Since the inductance of the coils 39 and 40 can be increased, low electric current and low electric power consumption can be realized.

6 Claims, 12 Drawing Sheets

WIRE DOT PRINTING HEAD

BACKGROUND OF THE INVENTION

The present invention relates to a wire dot printing head for an impact printer, and more particularly to a wire dot printing head for printing by driving a printing wire secured to the tip of an armature of the impact printer.

An impact printer executes printing on a printing medium by driving a printing wire, which presses an ink ribbon against the printing medium. Since printing media are readily available and comparatively cheap a well, this impact printer is widely used for various kinds of output devices, such as those of data processing systems.

Impact printers as described above can be classified into several categories, including the plunger type, the spring charge type and the clapper type.

The spring charge type of impact printer employs an armature which is supported by a bias leaf spring. A printing wire is secured to the armature. The armature is attracted in advance to a core by a permanent magnet against the elastic force of the above-described bias leaf spring. To initiate a printing stroke, a coil wound around the core is excited to generate magnetic flux in an opposite direction to that of the permanent magnet, whereby the armature is released. To achieve rapid printing, highly responsive wire dot printing heads of the spring charge type have been widely utilized.

FIG. 1 is a cross-sectional view illustrating a conventional spring charge type wire dot printing head.

In this drawing, a base 3, a ring 4, a permanent magnet 5, a magnet yoke 6, a spacer 7, a leaf spring 8 and an armature 9 are stacked in this order between a guide frame 1 and a cap 2. Reference number 10 designates a clamp spring.

On a resilient portion of the leaf spring 8, an armature 11 is disposed, and spring wire 12 is secured to the tip of the armature 11. The tip of the printing wire 12 is guided by a wire guide 13 so as to be directed toward a platen.

A core 14 is disposed toward the center of the base 3, and a coil 15 is wound around core 14. This coil 15 is fixed to a printed circuit board 17 through a coil bobbin 16. The coil 15 is connected electrically to the printed circuit board 17 through coil terminals 18. Between the printed circuit board 17 and the base 3, an insulation plate is inserted.

Further, numeral 20 denotes wire felt disposed in the wire guide 13, through which the printing wire 12 passes.

The above-described construction provides a magnetic circuit, and the magnetic flux generated by the permanent magnet 5 returns to the permanent magnet 5 after passing through the magnet yoke 6, the spacer 7, the armature yoke 9, the armature 11, the core 14, the base 3 and the ring 4. By this magnetic circuit, the armature 11 is attracted to the core and displaced. This displacement of the armature 11 accumulates distortion energy in the leaf spring 8 so that the leaf spring 8 is put in a biased condition.

Under this biased condition, when a magnetic flux having a direction opposite to that of the magnetic circuit is generated by exciting the coil 15, the magnetic flux generated by the permanent magnet 5 and the magnetic flux generated by the coil 15 negate each other. As a result, the force attracting the armature 11 is decreased.

Accordingly, the distortion energy accumulated in the leaf spring 8 is released and the leaf spring 8 reverts to an original position. The printing wire 12 fixed to the tip of the armature 11 protrudes through the wire guide 13 to press an ink ribbon and a printing medium (neither are shown) against a platen (not shown). As a result, characters and graphic patterns can be printed out.

However, in a wire dot printing head having the above-described construction, the magnetic flux of the electromagnet which is used to negate the magnetic flux generated by the permanent magnet also leaks through the adjacent armatures and cores. Accordingly, magnetic interference causes a change to the magnetic flux of the core.

Further, the greater the number of the dot wires printing at the same time, the larger the change in the magnetic flux caused by the above-described magnetic interference. A larger exciting current is required to release an armature than if the respective dot wire were driven in isolation. Accordingly, the temperature of the printing head increases accompanied by an increase in the power consumption.

Further, if the printing head is to be miniaturized for use in a small printer, a flexible design is difficult to achieve due to the limited coil space and restrictions on the coil winding turns and diameters.

SUMMARY OF THE INVENTION

An object of the present invention is to solve the above-described problems by minimizing the magnetic interference and decreasing the power consumption and the temperature rise. A further object of the present invention is to provide a wire dot printing head with a small size and an improved operational speed.

A wire dot printing head according to the present invention employs a spring, an armature mounted on the spring, a printing wire secured to the armature, a core disposed opposite to the spring, and a coil wound around the core for moving the armature by generating a magnetic flux when excited. The core is part of a core pair which includes a front core and a rear core corresponding to the armature. Front cores are disposed around a circle and rear cores are disposed around a circle. A permanent magnet is disposed between either of the front cores or the rear cores and a base plate. The coil is wound around either of the front core or rear core.

According to the present invention, as described above, front cores and rear cores are disposed in circles, and a core pair which includes one of the front cores and one of the rear cores cooperates with each armature. Between either of the front cores or the rear cores and the base plate, the permanent magnet is disposed. Since a coil is wound around either the front core or the rear core of a core pair, the inductance of the coil can be increased.

Further, since the permanent magnet is disposed between some of the cores and the base plate, the sectional area can be significantly reduced, so that a cost reduction can be achieved.

In addition, since the permanent magnet is disposed adjacent to the operational gap, magnetic flux leakage can be minimized.

DESCRIPTION OF THE PREFERRED EMBODIMENTS

First Embodiment

Figure 1:
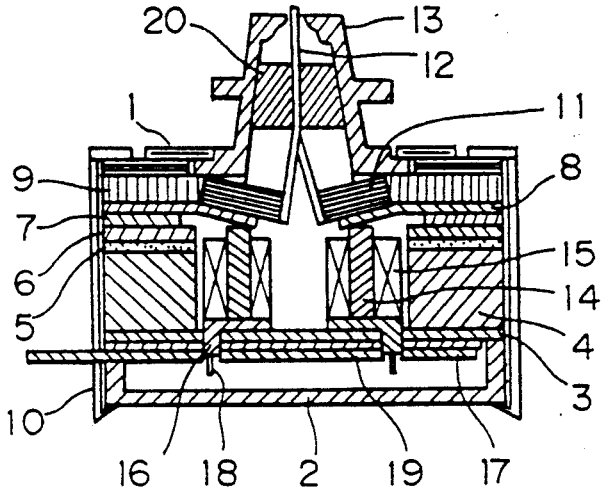
Fig. 1 (PRIOR ART)
FIG. 1 is a cross-sectional view illustrating a conventional wire dot printing head.
Figure 2:
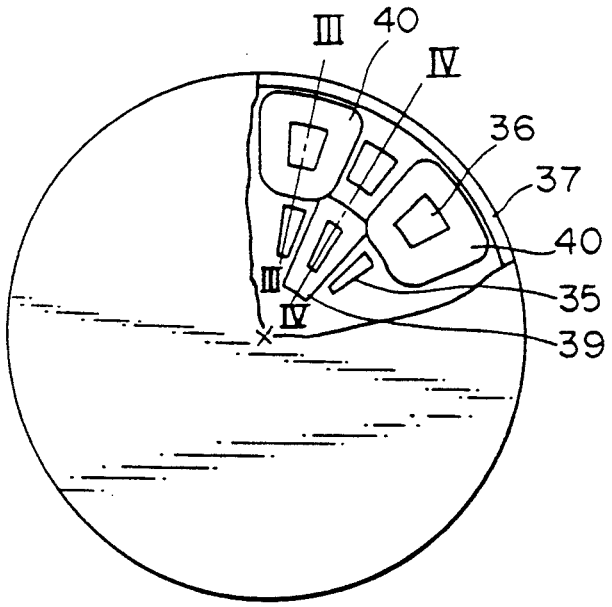
FIG. 2 is a plan view, partially broken away, illustrating a wire dot printing head according to a first embodiment of the present invention.
Figure 3:
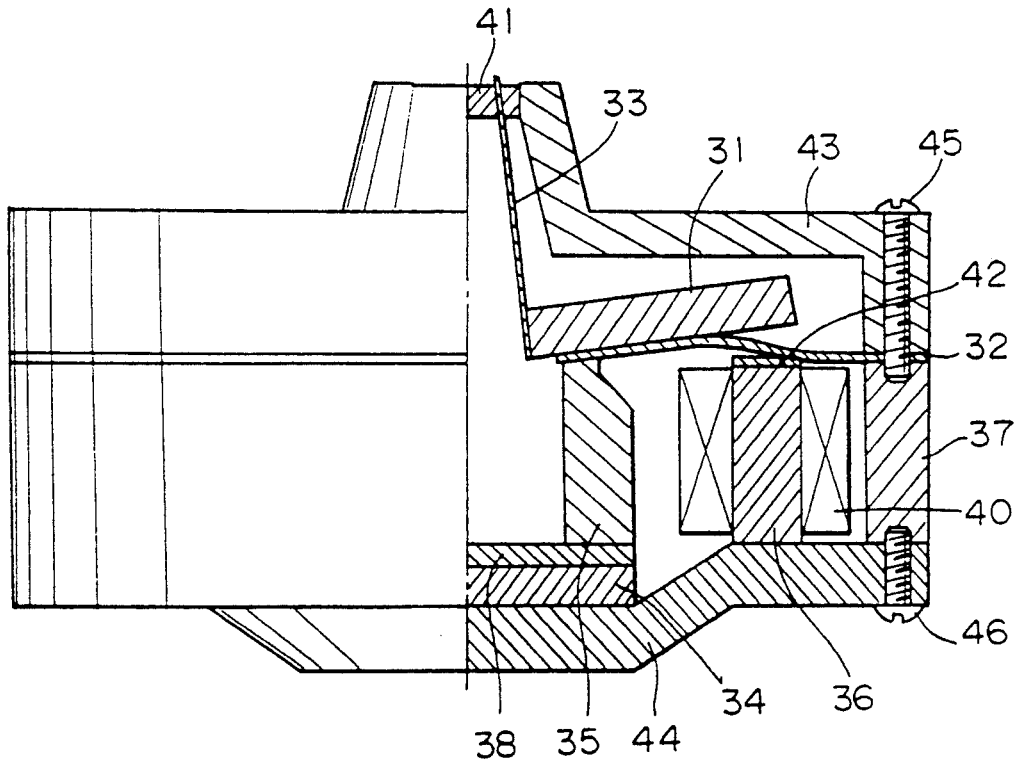
FIG. 3 illustrates a side view on the left and a cross-sectional view on the right, the cross section being taken along line III—III in FIG. 2.
Figure 4:
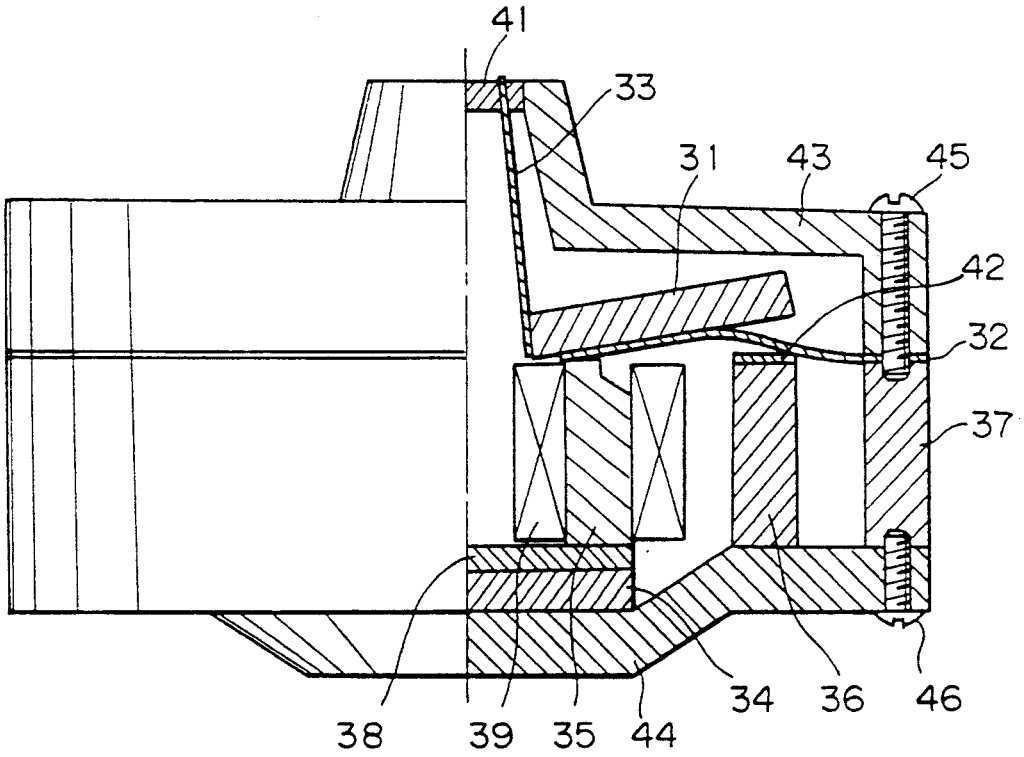
FIG. 4 illustrates a side view on the left and a cross-sectional view on the right, the cross section being taken along line IV—IV in FIG. 2.
Figure 5:
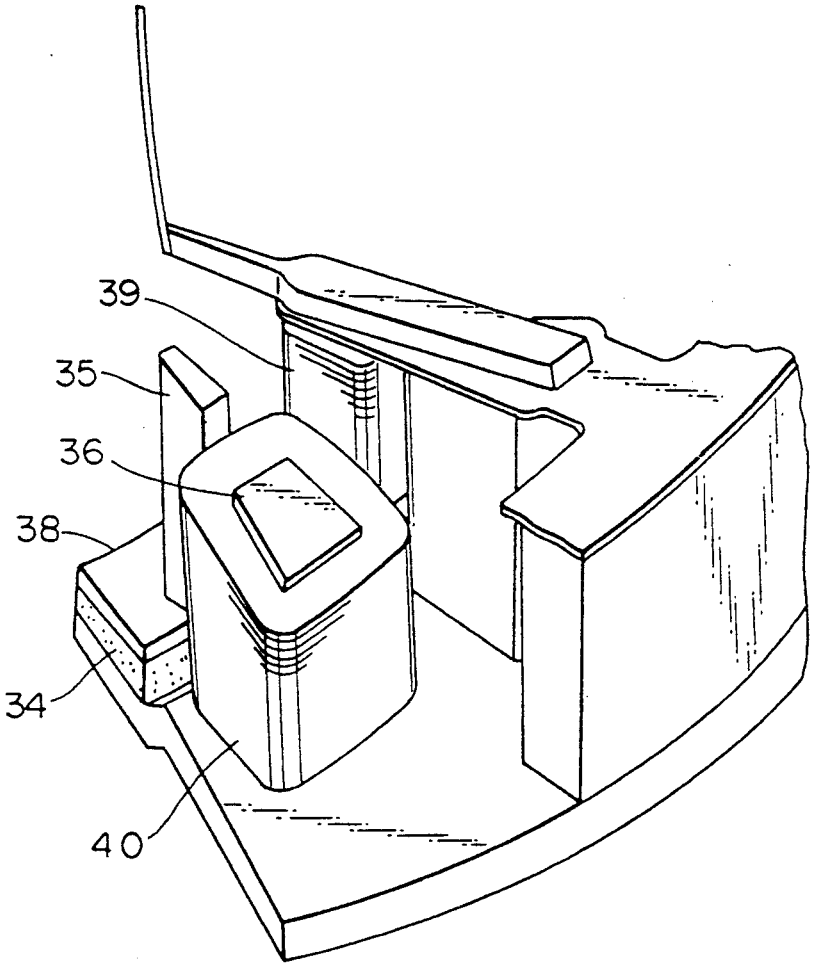
FIG. 5 is a perspective view illustrating a portion of the wire dot printing head of the first embodiment of the present invention.

FIG. 3 illustrates a wire dot printing head according to a first embodiment of the present invention, with part of FIG. 3 representing a cross section taken along line III—III in FIG. 2. Part of FIG. 4 is a cross section taken along line IV—IV in FIG. 2. FIG. 2 is a plan view, partially broken away, illustrating the wire dot printing head of the first embodiment. FIG. 5 is a perspective view illustrating part of the wire dot printing head of the first embodiment.

In the drawings, numeral 31 denotes an armature. A printing wire 33 is secured to the tip of armature 31. Numeral 32 denotes a leaf spring to which the armature 31 is secured by laser welding or so forth. Numeral 34 denotes a permanent magnet for attracting the armature. The permanent magnet 34 is disposed on the side of a front core 35.

The front core 35 is part of a core pair which also includes a rear core 36. The front core 35 and the rear core 36 are disposed at different radial positions in the printing head.

Numeral 37 denotes a ring on which the leaf spring 32 is fixed. Numeral 38 denotes a magnet yoke disposed between the front core 35 and the permanent magnet 34.

Further, numeral 39 denotes a coil wound around the front core 35; and numeral 40 also denotes a coil wound around the rear core 36. The coils 39 and 40, as shown in FIGS. 2 and 5, are wound alternately around the front cores 35 or the rear cores 36.

Numeral 41 denotes a wire guide. Numeral 42 denotes a metallic residual sheet inserted between the core 36 and the leaf spring 32 both to protect the core surface and to give an initial displacement to the leaf spring 32. Numeral 43 denotes a guide frame positioning the wire guide 41. Numeral 44 denotes a base plate on which the cores 35 and 36 and the permanent magnet 34 are mounted. The guide frame 43 and the base plate 44 are fixed with screws 45 and 46 to the ring 37, with the leaf spring 32 in between.

The operation of the wire dot printing head having the above-described construction will be explained hereinafter.

While not printing, electric current is not applied to the coils 39 to 40. Magnetic flux generated by the permanent magnet 34 constitutes a magnetic flux loop passing through the magnet yoke 38, the front core 35, the armature 31, the rear core 36 and the base plate 44. This magnetic flux loop attracts the armature 31 to the cores 35 and 36 against the force of the lead spring 32, so that distortion energy is accumulated in leaf spring 32.

Now, assume that a wire 33 is to be selectively driven during a printing stroke. A core corresponding to the wire that is to be driven is selected from among the front cores 35 wound by the coils 39 as shown in FIG. 4 and the rear cores 36 wound by the coils 40 as shown in FIG. 3. By applying electric current to the coil 39 or 40, a magnetic flux loop is formed in an opposite direction to the magnetic flux loop generated by the permanent magnet 34.

Winding the coils 39 and 40 alternately around the adjacent cores 35 and 36 doubles the installation space for the coils 39 and 40 as compared with that for a conventional wire dot printing head. Furthermore the inductance can be increased, the electric current to drive the coils 39 and 40 can be decreased, and the electric power consumption can also be decreased.

Further, since the adjacent coils 39 and 40 are disposed separately from each other, the magnetic interference generated while exciting the coils is reduced.

In this way, since the wire dot printing head of the first embodiment of the present invention is constituted such that front cores 35 and rear cores 36 are disposed plurally in circular form, with a front core 35 and a rear core 36 being provided for each armature 31, and such that the permanent magnet 34 is disposed between either of the above-described front cores 35 or the rear cores 36 and the base plate 44, and such that either of the above-described front core 35 or the rear core 36 is wound around alternately by a coil 39 or 40, inductance of the coils can be increased. Accordingly, both low electric current and low electric power consumption can be realized.

Further, since the permanent magnet 34 is disposed between the cores 35 or 36 and the base plate 44, the sectional area becomes significantly smaller and the cost is reduced.

Further, since the permanent magnet 34 is disposed adjacent to the operational gap, magnetic flux leakage can be minimized so that the effective magnetic flux can be efficiently utilized. Additionally, since each of the adjacent coils 39 and 40 is disposed separately from each other, the magnetic interference caused by the electromagnet can be reduced.

Second and Third Embodiment

Figure 6:
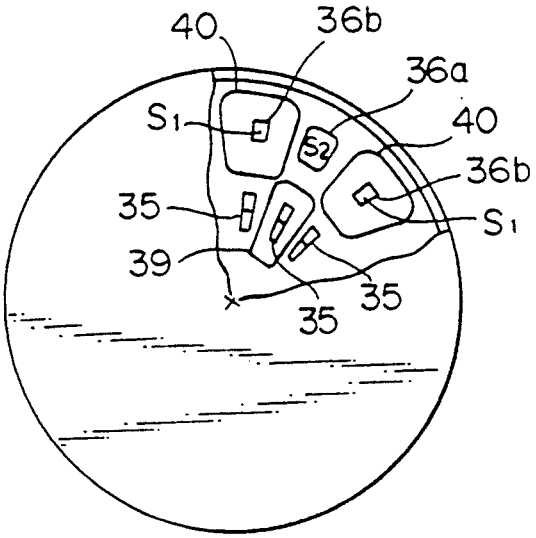
FIG. 6 is a plan view, partially broken away, illustrating a wire dot printing head in accordance with a second embodiment of the present invention.
Figure 8:
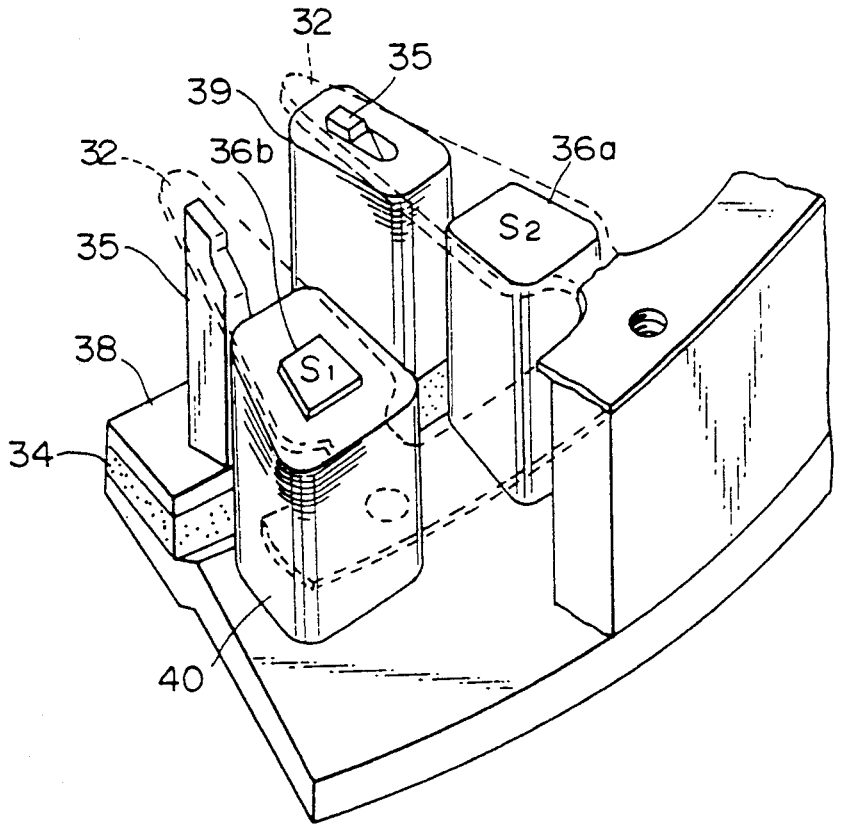
FIG. 8 is a perspective view illustrating a portion of the wire dot printing head in accordance with the second embodiment of this invention.

FIG. 6 is a plan view, partially broken away, illustrating the second embodiment of the present invention, and FIG. 8 is an exploded perspective view illustrating an essential part of the second embodiment of the present invention. According to FIGS. 6 and 8, the paired cores include a front core 35 and either a first rear core 36*a* or a second rear core 36*b*. The second rear cores 36*b* and the first rear cores 36*a* are disposed alternately around a circle The sectional area S1 of the second rear cores 36*b* is smaller than the sectional area S2 of the first rear cores 36*a*. Rear coils 40 are wound around the second rear cores 36*b* but not the first rear cores 36*a*. Moreover, a front core 35 that is paired with a second rear core 36*b* does not have a coil, whereas a front core 35 that is paired with a first rear core 36*a* has a front core coil 39. Except that the sectional area S1 of the second rear cores 36*b* is smaller and the second rear cores 36*b* are also thinner, the other structures are the same as those in the first embodiment. Accordingly, the other parts, such as the armatures and printing wires, are omitted in the drawings for explaining this embodiment but can be readily understood by reference to FIG. 2–FIG. 5.

The operation of the second embodiment will be explained hereinafter.

As shown in FIG. 8, while not printing, the leaf spring 32 (illustrated with a dashed line) is attracted to the front core 35 and the second rear core 36*b* by magnetic flux generated by the permanent magnet 34. Since the sectional area S1 of the second rear core 36*b* is set to be small, the magnetic flux volume passing through the second rear core 36*b* is smaller than that passing through the first rear core 36*a*. Accordingly, the force to attract the leaf spring 32 to both the front core 35 and the second rear core 36*b* becomes smaller than the force to attract the leaf spring 32 to both the front core 35 and the first rear core 36*a*. Under this condition, a printing wire (not shown) is driven An electric current is applied to the rear core coil 40 or the front core coil 39 of the paired cores corresponding to a desired printing wire. When the electric current is applied to the rear core coil 40 or the front core coil 39, a magnetic flux in an opposite direction to the magnetic flux generated by the permanent magnet 34 passes through the second rear core 36*b* or the first rear core 36*a*, the leaf spring 32, an armature (not shown) and the front core to negate the magnetic flux generated by the permanent magnet 34. Since the magnetic flux generated by the permanent magnet 34 passing through the second rear core 36*b* is comparatively small, the magnetic flux to negate this can be made small. Accordingly, the current supplied to the rear core coil 40 wound around the second rear core 36*b* can be decreased. Also, the duration of the current for the rear core coil 40 can be made shorter. Further, by adjusting the size of the sectional area S1 of the second rear cores 36*b* so that the duration of the current through a rear core coil 40 that is necessary to release a leaf spring 32 which is attracted to a core pair formed by a front core 35 and a second rear core 36*b* is equal to the duration of the current through a front core coil 39 that is necessary to release a leaf spring 32 which is attracted to a core pair formed by a front core 35 and a first rear core 36*a*, printing control can be much simplified.

When the magnetic flux generated by the permanent magnet 34 is negated, the leaf spring 32 is released and its accumulated distortion energy moves the printing wire secured to the corresponding armature (not shown) upward.

Figure 7:
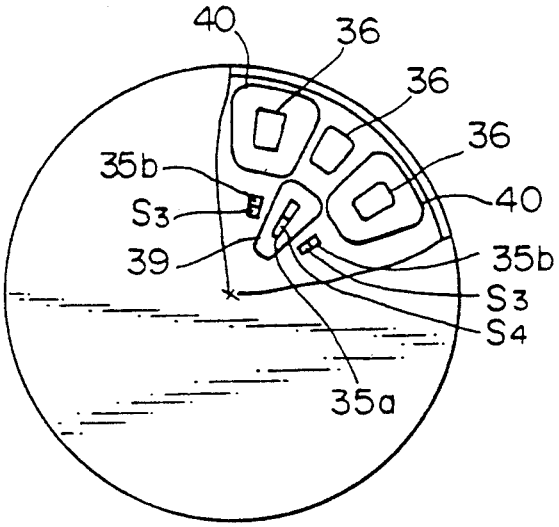
FIG. 7 is a plan view, partially broken away, illustrating a wire dot printing head in accordance with a third embodiment of the present invention.

Referring to FIG. 7, the third embodiment of the present invention will be explained hereinafter.

As shown in FIG. 7, this embodiment is characterized in that the sectional area S3 of second front cores 35*b* in front of rear cores 36 with coils 40 is smaller than the sectional area S4 of first front cores 35*a* having coils 39. The other structures are all the same as those in the first embodiment. In this embodiment, similar to the second embodiment, the magnetic flux generated by the permanent magnet attracts the armature 31 mounted on the leaf spring to both the second front core 35*b* and the rear core 36. Since the sectional area S3 of the second front core 35*b* is set to be smaller, the magnetic flux generated by the permanent magnet also becomes small. Accordingly, when the printing wire is driven, as described in the second embodiment, the magnetic flux to negate the magnetic flux generated by the permanent magnet can be minimized. As a result, the current supplied to the rear core coil 40 wound around the rear core 36 can be decreased. Alternatively, the duration of the current for the rear core coil 40 can be made shorter.

In the above-described second and third embodiments, though the sectional area of the rear core 36 or the front core 35 in a core pair which includes a rear core 36 with a coil 40 is set to be small, depending on the installation position of the permanent magnet 34, the present invention does not exclude reducing the sectional area of the rear core 36 or the front core 35 in a core pair which includes a front core 35 with a coil 39.

Fourth Embodiment

Figure 9:
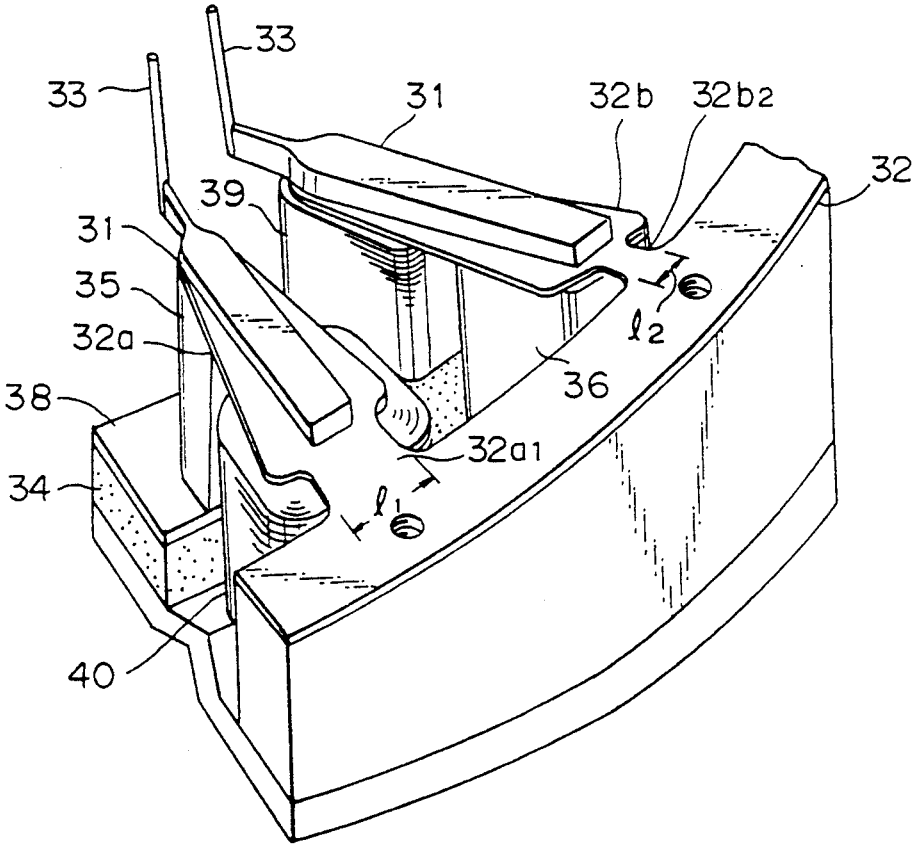
FIG. 9 is a perspective view illustrating a portion of a wire dot printing head in accordance with a fourth embodiment of the present invention.
Figure 10:
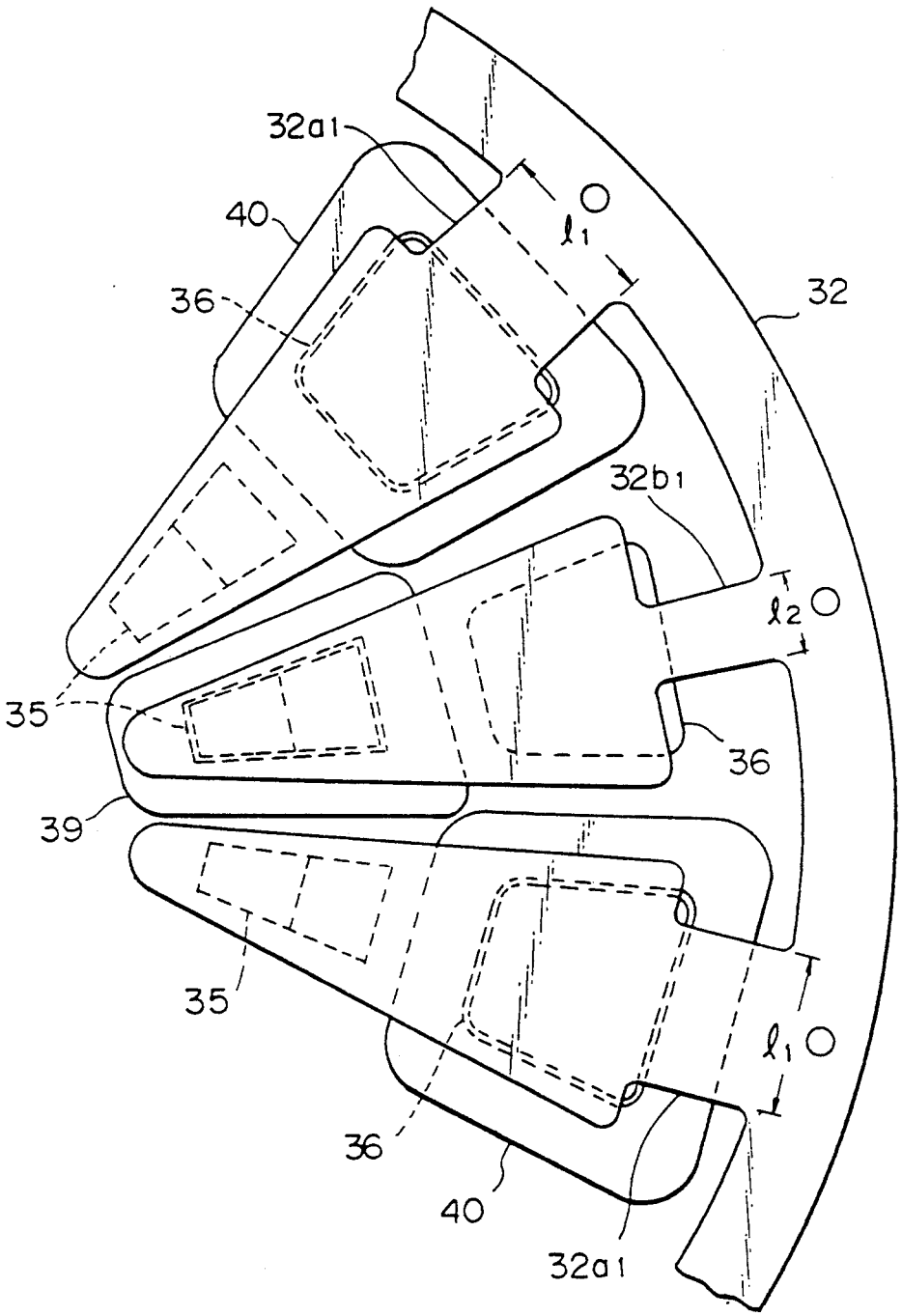
FIG. 10 is a plan view illustrating part of the wire dot printing head in accordance with the fourth embodiment of the present invention.

FIG. 9 is an exploded perspective view illustrating an essential part of the fourth embodiment of the present invention; and FIG. 10 is a plan view illustrating an essential part of the fourth embodiment of the present invention.

In FIGS. 9 and 10, the leaf spring 32 includes first and second leaf spring portions 32*a* and 32*b* which extend inwardly above each of the paired cores. The leaf spring portions 32*a* extend above core pairs which include a rear core 36 with a coil 40, and the second leaf spring portions 32*b* extend above core pairs which include a front core 35 with a coil 39. Armatures 31 are fixed on both the leaf spring portions 32*a* and 32*b*. The width l1 of the resilient part $32a_1$ of the first leaf spring portions 32*a* is larger than the width l2 of the resilient part $32b_2$ of the second leaf spring portions 32*b*. Accordingly, the first leaf spring portions 32*a* require a stronger force for deflection than the second leaf spring portions 32*b*, so that the recovery force to revert to the original position becomes stronger.

Since the other structures are all the same as those in the first embodiment, the explanation of them will be omitted.

The operation of this embodiment will be explained hereinafter.

While not printing, the armatures 31 on both the first leaf spring portions 32*a* and the second leaf spring portions 32*b* are attracted by the magnetic flux generated by the permanent magnet 34. Since the magnetic flux volume passing through each of the paired cores is equal, the attracting forces in this case are also equal with each other. With these attracting forces, the first leaf spring portion 32*a* and the second leaf spring portion 32*b* are attracted to each of the paired cores. However, since the recovery force of the first leaf spring portions 32*a* is stronger than that of the second leaf spring portions 32*b*, the magnetic flux volume necessary to release the first leaf spring portions 32*a* from the paired cores, that is, the coercive force, is smaller than that necessary to release the second leaf spring portions 32*b* from the paired cores. Under this condition, the printing wire is driven.

The electric current is applied to the rear core coil 40 or the front core coil 39 of the paired cores corresponding to the printing wire 33 that is to be driven. When the electric current is applied to the front core coil 39 or the rear core coil 40, magnetic flux in a direction opposite to that of the magnetic flux generated by the permanent magnet 34 passes to the rear core 36, the leaf spring portion 32*a* or 32*b*, the armature 31 and the front core 35 to negate the magnetic flux generated by the permanent magnet 34. Though all of the magnetic flux generated by applying the electric current to the rear core coil 40, as described above, due the magnetic flux leakage, is not used to negate the magnetic flux generated by the permanent magnet 34, the first leaf spring portion 32*a* is released even though the magnetic flux generated by applying the electric current to the rear core coil 40 is small. This is because the coercive force at the leaf spring portion 32*a* is small. Accordingly, the value of the electric current supplied to the rear core coil 40 wound around the rear core 36 can be decreased, or the duration of the current for the rear coil 40 can be made shorter. By adjusting the coercive force of the first leaf spring portion 32*a* and further the width $l_1$ of the resilient part $32a_1$ of the first leaf spring portion 32*a* so that the duration of the current through the rear core coil 40 that is necessary to release the first leaf spring portion 32*a* is equal to the duration of the current through the front core coil 39 that is necessary to release the second leaf spring portion 32*b*, control of the current duration is simplified.

As described above, according to the fourth embodiment, the width of the resilient part of the first leaf spring portion 32*a*, corresponding to a pair of cores with a coil around the rear core 36, is set to be larger so that the coercive force when the first leaf spring portion 32*a* is attracted becomes small. Accordingly, the value of the electric current supplied to the rear core coil 39 can be decreased, or the current duration can be made shorter.

Fifth Embodiment

Figure 11:
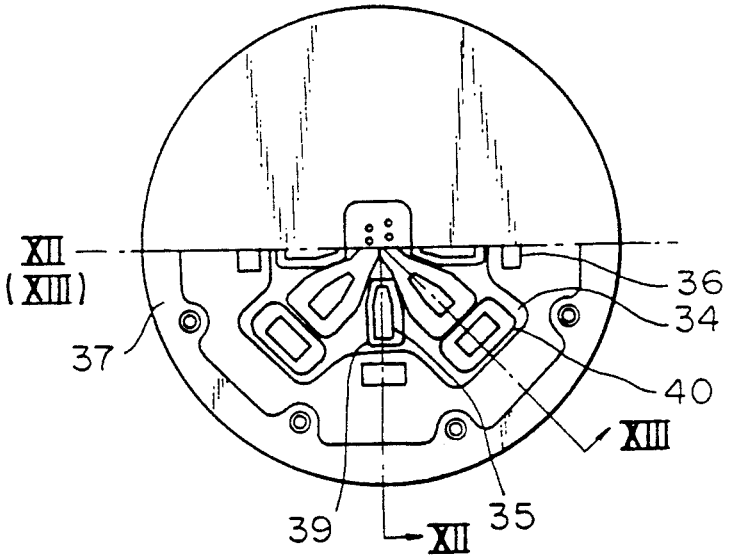
FIG. 11 is a plan view illustrating part of a wire dot printing head in accordance with a fifth embodiment of the present invention.
Figure 12:
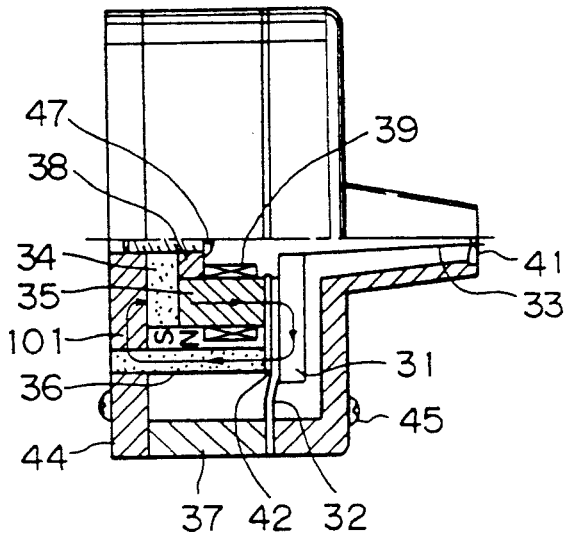
FIG. 12 illustrates a side view at the top and a cross-sectional view at the bottom, the cross section being taken along line XII—XII in FIG. 11.
Figure 13:
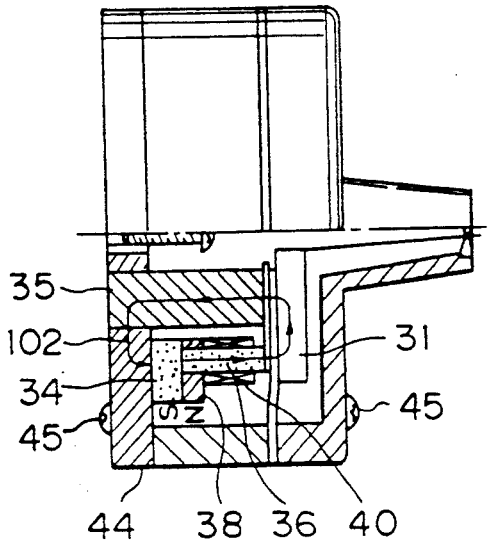
FIG. 13 illustrates a side view at the top and a cross-sectional view at the bottom, the cross section being taken along line XIII—XIII in FIG. 11.
Figure 14:
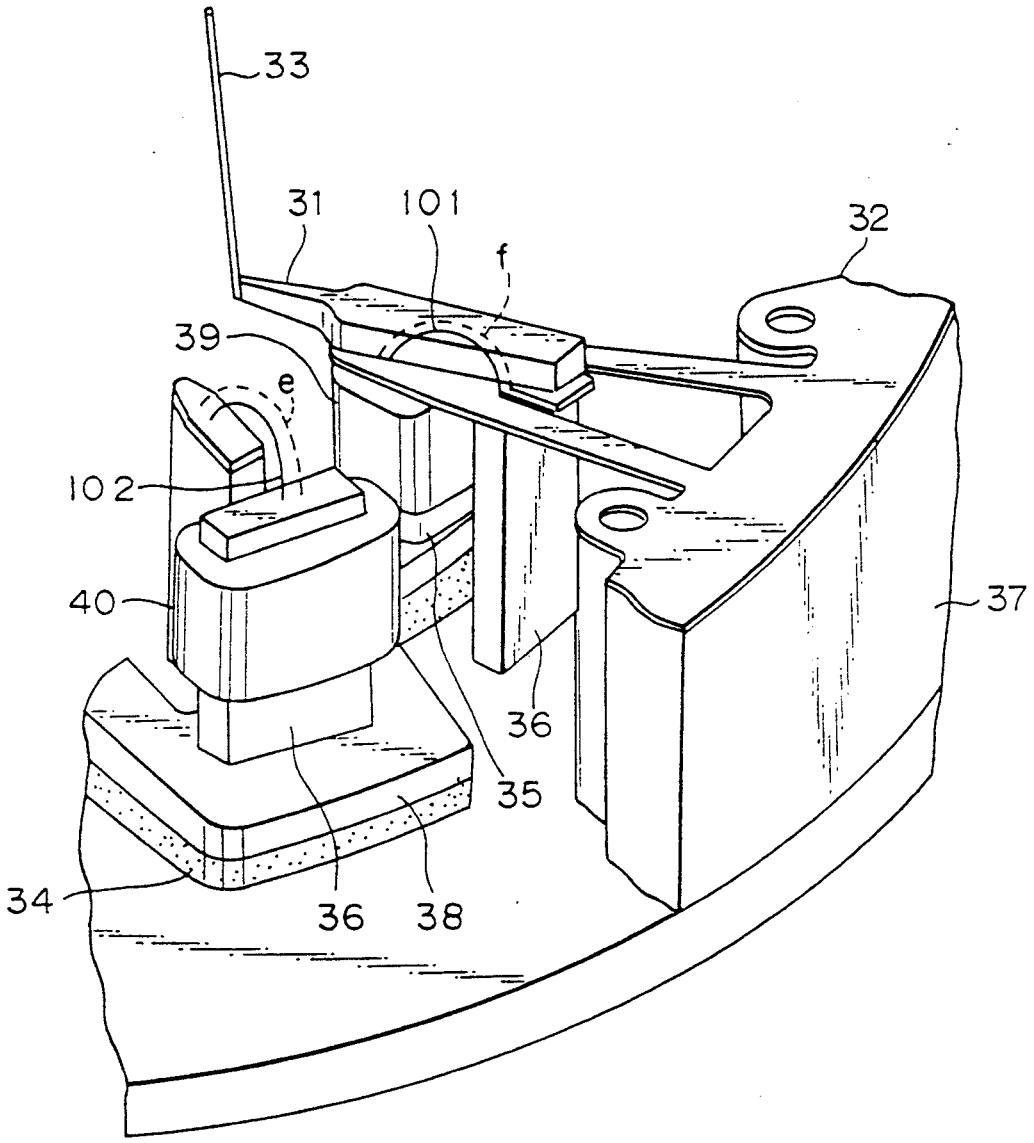
FIG. 14 is a perspective view illustrating part of a wire dot printing head in accordance with a fifth embodiment of the present invention.
Figure 15:
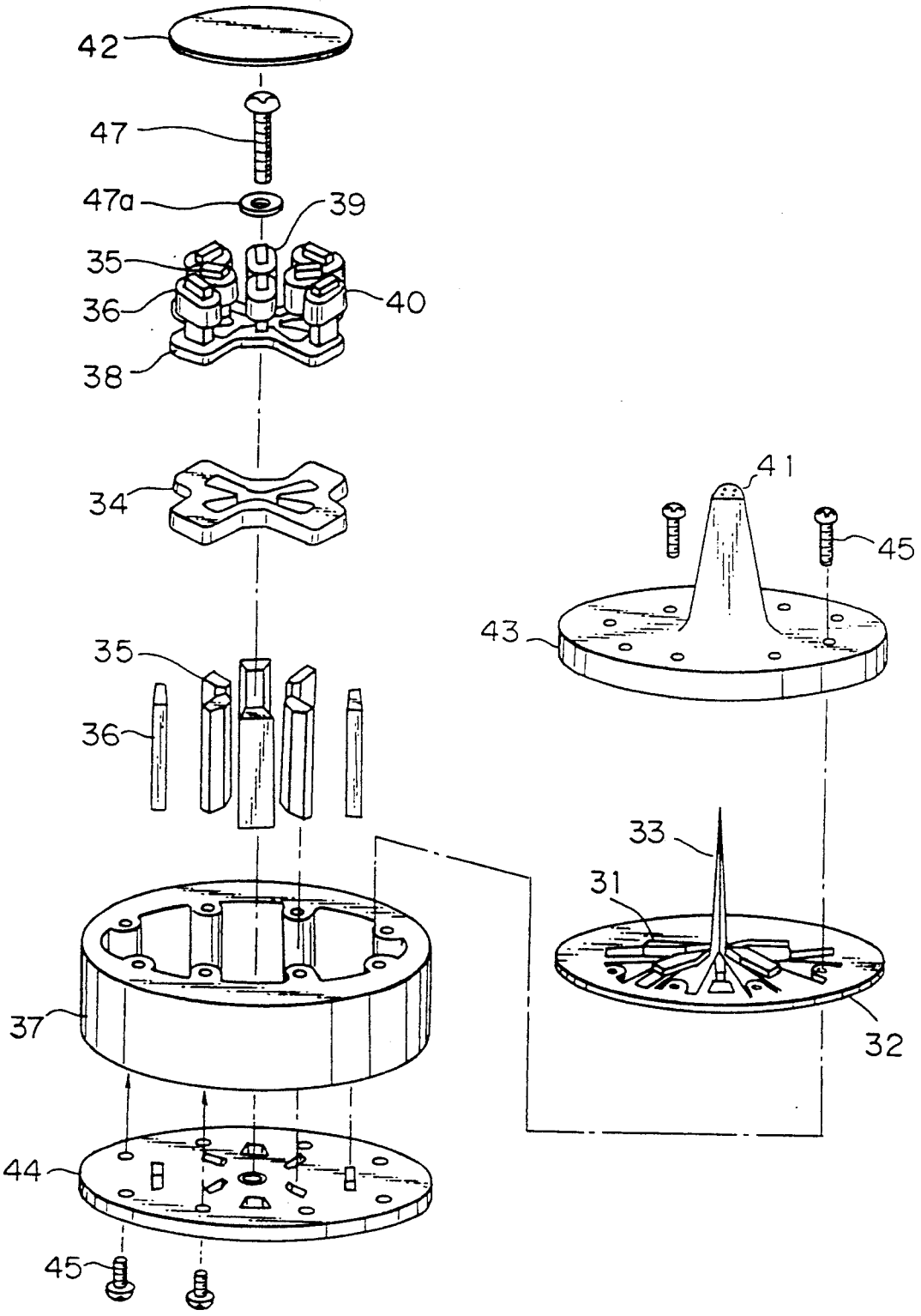
FIG. 15 is an exploded perspective view illustrating a wire dot printing head in accordance with the fifth embodiment of the present invention.

FIG. 11 is a plan view illustrating an essential part of the wire dot printing head of the fifth embodiment of the present invention; part of FIG. 12 is a cross section taken along line XII—XII in FIG. 11; part of FIG. 13 is a cross section taken along line XIII—XIII in FIG. 11; FIG. 14 is a perspective view illustrating an essential part of the wire dot printing head; and FIG. 15 is an exploded perspective view illustrating an essential part of the wire dot printing head.

Two kinds of cores 35 and 36, as shown in FIGS. 12 and 13, are disposed alternately in a radial form as shown in FIG. 11 to constitute the printing head.

In the drawings, 31 denotes an armature having a printing wire 33 secured to its tip, and 32 denotes a leaf spring to which the armature 31 is secured by laser welding or the like. Numeral 34 denotes a permanent magnet magnetized in the direction of its thickness. Numeral 35 denotes a front core, 36 denotes a rear core, and 44 denotes a round-shape base plate which is made from magnetic material and to which alternate front cores 35 and rear cores 36 are secured. Reference numeral 37 denotes a spacer ring to which the leaf spring 32 is fixed. Numeral 38 denotes a magnet plate for securing alternate front cores 35 and rear cores 36 to the permanent magnet 34. Numeral 47 denotes a screw for fixing the magnet plate 38, the permanent magnet 34 and the base plate 44. Numeral 47*a* denotes a washer. Numeral 39 denotes a coil wound around a front core 35, and 40 denotes a coil wound around a rear core 36. Numeral 42 denotes a residual sheet inserted between the front cores 35, the rear cores 36 and the leaf spring 32 for protecting the surfaces of the cores. Numeral 43 denotes a guide frame which is disposed on the opposite side of the leaf spring 32 from the spacer ring and which is provided with a wire guide 41.

In the base plate 44, installation holes for some of the front cores 35 and the rear cores 36 are formed alternately in the circumferential direction, and front cores 35 are inserted into every other hole and rear cores 36 are inserted into every other hole in the same way.

Installation holes for some of the front cores 35 and the rear cores 36 are also formed alternately in the magnetic plate 38 in the circumferential direction. The rear cores 36 corresponding to the front cores 35 fixed onto the above-described base plate 44, and the front cores 35 corresponding to the rear cores 36 fixed on the base plate 44, are inserted into installation holes of magnetic plate 38, with front cores and rear cores being alternately inserted in every other hole. The front core coils 39 and rear core coils 40 are respectively wound around the front cores 35 and rear cores 36 that are fixed on the magnet plate 38.

This magnet plate 38 is formed so as to have the identical external shape as the permanent magnet 34. And, to avoid interference from the front cores 35 and the rear cores 36 fixed respectively on the base plate 44, an opening and recesses are formed in both of them. When the permanent magnet 34 and the magnet plate 38 are fixed upon the center of the base plate 44 by a screw, with the front and rear cores 35 and 36 being fixed in their respective installation holes, each of the front cores 35 and the rear cores 36 is disposed sequentially in the circumferential direction. Accordingly, in this embodiment, a first magnetic assembly and a second magnetic assembly are formed.

Further, the front cores 35 and the rear cores 36 can be formed integrally with the base plate 44 and the magnet plate 38 respectively in one body.

The operation of the wire dot printing head having the above-described construction will be explained hereinafter.

When not printing, an electric current is not applied to the coils. As shown in FIG. 12, a magnetic flux loop 101 passing through the front core 35, the armature 31, the rear core 36 and the base plate 44 in this order is formed by the permanent magnet 34. As a result, the armature 31 is attracted to the front core 35 against the force of the leaf spring 32, and the leaf spring 32 accumulates distortion energy.

Meanwhile in FIG. 13, in the same way, a magnetic flux loop 102 passing through the rear core 36, the armature 31, the front core 35 and the base plate 44 in this order is formed by the permanent magnet 34, so that the armature 31 is attracted to the front core 35.

In this case, the polarities of the adjacent magnetic flux loops 101 and 102 are opposite to each other.

Next, in FIG. 14, when a printing wire 33 is selectively driven to print, magnetic flux in the opposite direction to the magnetic flux loop 101 generated by the permanent magnet 34 is produced by supplying an electric current to the exciting coil 39 corresponding to that printing wire 33, as shown with the dotted line f.

Since the coils 39 and 40 are wound around the cores 35 and 36 which are disposed on the magnetic plate 38 and the permanent magnet 39, most of the magnetic flux 102 generated by the permanent magnet 34 passes through these cores 35 and 36. That is, the magnetic flux leakage from the magnetic fluxes 101 and 102 generated by the permanent magnet 34 is so small that they can pass through inside the coils 39 and 40. As a result, the magnetic fluxes e and f generated by the coils 39 and 40 can effectively negate the magnetic flux generated by the permanent magnet 34.

In the wire dot printing head having the above-described construction as shown in FIG. 15, since an integral-type permanent magnet 34 is used and a manufacturing process to magnetize it after the assembly of the printing head can be adopted, the production cost can be decreased.

The present invention is suitable for use in various kinds of information processing devices, especially printers, to obtain hard copies readily. Among other things, the present invention is suitable for a serial printer with low power consumption and stabilized operation.

We claim:

1. A wire dot printing head, comprising:

a base plate made from magnetic material, the base plate having a periphery;

a plurality of core pairs, each core pair including a front core and a rear core, the rear cores being disposed along an outer circle adjacent the periphery of the base plate and the front cores being disposed along an inner circle inside the outer circle, each core having a respective sectional area;

a permanent magnet disposed between the base plate and one of the cores of each pair;

a plurality of coils, one of the coils being wound around one of the cores of each pair, the coils being distributed among the front and rear cores in such a manner that alternate front cores have coils and alternate rear cores have coils;

a plurality of printing wires; and means for movably mounting the printing wires, the means for movably mounting the printing wires including a plurality of spring portions, each spring portion being disposed over a respective one of the core pairs, wherein the sectional areas of the front cores that have coils are larger than the sectional areas of the front cores that do not have coils.

2. A wire dot printing head, comprising:

a base plate made from magnetic material, the base plate having a periphery;

a plurality of core pairs, each core pair including a front core and a rear core, the rear cores being disposed along an outer circle adjacent the periphery of the base plate and the front cores being disposed along an inner circle inside the outer circle, each core having a respective sectional area;

a permanent magnet disposed between the base plate and one of the cores of each pair;

a plurality of coils, one of the coils being wound around one of the cores of each pair, the coils being distributed among the front and rear cores in such a manner that alternate front cores have coils and alternate rear cores have coils;

a plurality of printing wires; and means for movably mounting the printing wires, the means for movably mounting the printing wires including a plurality of sprint portions, each spring portion being disposed over a respective one of the core pairs, wherein the sectional areas of the rear cores having coils are smaller than the sectional areas of the rear cores which do not have coils.

3. A wire dot print head, comprising:

a base plate made from magnetic material, the base plate having a periphery;

a plurality of core pairs, each core pair including a front core and a rear core, the rear cores being disposed along an outer circle adjacent the periphery of the base plate and the front cores being disposed along an inner circle inside the outer circle;

a permanent magnet disposed between the base plate and one of the cores of each pair; a plurality of coils, one of the coils being wound around one of the cores of each pair, the coils being distributed among the front and rear cores in such a manner that alternate front cores have coils and alternate rear cores have coils;

a plurality of printing wires; and means for movably mounting the printing wires, the means for movably mounting the printing wires including a plurality of spring portions, each spring portion being disposed over a respective one of the core pairs, each spring portion having a resilient part with a respective width, wherein the resilient parts of the spring portions that are disposed over core pairs which include a rear core that has a coil are wider than the resilient parts of the spring portions that are disposed over core pairs which include a rear core that does not have a coil.

4. A wire dot print head, comprising:

a base plate made from magnetic material, the base plate having a periphery;

a plurality of core pairs, each core pair including a front core and a rear core, the rear cores being disposed along an outer circle adjacent the periphery of the base plate and the front cores being disposed along an inner circle inside the outer circle;

a plurality of coils, one of the coils being wound around one of the cores of each pair, the coils being distributed among the front and rear cores in such a manner that alternate front cores have coils and alternate rear cores have coils;

a permanent magnet disposed between the base plate and the cores which have coils but not between the base plate and the cores which do not have coils, the permanent magnet having a first surface which constitutes a first pole and which is oriented toward the cores having coils, the permanent magnet additionally having a second surface which constitutes a second pole and which is oriented toward the base plate;

a plurality of printing wires; and means for movably mounting the printing wires, the means for movably mounting the printing wires including a plurality of sprint portions, each spring portion being disposed over a respective one of the core pairs, wherein the cores that do not have coils are affixed to the base plate, and wherein the permanent magnet has an opening through which some of the cores that are affixed to the base plate extend, the opening being non-circular.

5. The wire dot printing head of claim 4, further comprising a magnetic plate on which the cores that have coils are mounted, the magnetic plate being disposed on the first surface of the permanent magnet.

6. The wire dot printing head of claim 4, wherein the means for movably mounting the printing wires comprises a spring element having an annular peripheral portion, the spring portions being part of the spring element and extending inward from the annular peripheral portion thereof, and armatures affixed to the spring portions, the printing wires being connected to the armatures.

* * * * *